US008396242B2

(12) United States Patent
Watanabe

(10) Patent No.: US 8,396,242 B2
(45) Date of Patent: Mar. 12, 2013

(54) SOUND RECEIVER

(75) Inventor: Junichi Watanabe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 731 days.

(21) Appl. No.: 12/010,441

(22) Filed: Jan. 24, 2008

(65) Prior Publication Data

US 2008/0212804 A1 Sep. 4, 2008

Related U.S. Application Data

(63) Continuation of application No. PCT/JP2005/013602, filed on Jul. 25, 2005.

(51) Int. Cl.
*H04R 1/02* (2006.01)
*H04R 5/00* (2006.01)

(52) U.S. Cl. ..... 381/360; 381/26; 381/91; 381/160

(58) Field of Classification Search ..... 381/26, 381/91, 95, 122, 160, 182, 324, 337, 339, 381/345, 351–354, 355–361, 365, 368, 369, 381/374–375, 395; 181/198; 379/388.02
See application file for complete search history.

(56) References Cited

U.S. PATENT DOCUMENTS

| | | | | |
|---|---|---|---|---|
| 4,399,327 | A * | 8/1983 | Yamamoto et al. | 381/92 |
| 4,836,328 | A * | 6/1989 | Ferralli | 181/155 |
| 4,967,874 | A * | 11/1990 | Scalli | 181/158 |
| 5,492,129 | A * | 2/1996 | Greenberger | 600/528 |
| 5,548,651 | A * | 8/1996 | Long | 381/67 |
| 5,870,485 | A * | 2/1999 | Lundgren et al. | 381/306 |
| 6,002,777 | A * | 12/1999 | Grasfield et al. | 381/67 |
| 6,438,238 | B1 * | 8/2002 | Callahan | 381/67 |
| 2002/0076041 | A1 | 6/2002 | Hietanen | |
| 2002/0193130 | A1 | 12/2002 | Yang | 455/501 |
| 2004/0151335 | A1 | 8/2004 | Pavlovic | |

FOREIGN PATENT DOCUMENTS

| | | |
|---|---|---|
| CN | 2209417 | 10/1995 |
| CN | 2305027 | 1/1999 |
| CN | 1399495 | 2/2003 |
| EP | 0992973 | 4/2000 |
| EP | 1253802 | 10/2002 |
| EP | 1494500 | 1/2005 |
| EP | 1838131 | 9/2007 |
| FR | 2650466 | 2/1991 |
| GB | 2234137 | 1/1991 |
| JP | 59-15393 | 1/1984 |

(Continued)

OTHER PUBLICATIONS

McKee, Anita M. et al., "Beam Shape, Focus Index, and Localization Error for Performance Evaluation of a Multisensor Stethoscope Beamformer", Sep. 2004, IEEE, Proceedings of the 26th Annual International Conference of the IEEE EMBS, pp. 2062-2065.*

(Continued)

*Primary Examiner* — Jesse Elbin
(74) *Attorney, Agent, or Firm* — Staas & Halsey LLP

(57) ABSTRACT

In a sound receiver, a sound wave is directly received by microphones at a predetermined phase difference. The microphones are arranged in opening cavities of a casing, at positions that are different from the volume center points of the opening cavities. The microphones are supported by supporting springs in a state of not closely contacting inner peripheral walls. The sound wave received by the microphones is input to a signal processing unit and after a signal component in a predetermined low frequency band is removed by a filter, the resulting sound wave is amplified by an amplifier and is made in phase by a phase shifter and output.

24 Claims, 11 Drawing Sheets

FOREIGN PATENT DOCUMENTS

| | | |
|---|---|---|
| JP | 62-281596 | 12/1987 |
| JP | 63-87983 | 6/1988 |
| JP | 3-131199 | 6/1991 |
| JP | 04-318796 | 11/1992 |
| JP | 04-322598 | 11/1992 |
| JP | 06-095840 | 4/1994 |
| JP | 08-168089 | 6/1996 |
| JP | 8-251682 | 9/1996 |
| JP | 8-289275 | 11/1996 |
| JP | 10-48036 | 2/1998 |
| JP | 10-145883 | 5/1998 |
| JP | 2000-124978 | 4/2000 |
| JP | 2002-354570 | 12/2002 |

OTHER PUBLICATIONS

Extended European Search Report dated Jan. 23, 2009 in corresponding European Application No. 05766214.0 (9 pp.).

Choi, S. et al., *A new microphone for near whispering*, The Journal of the Acoustical Society of America, American Institute of Physics for the Acoustical Society of America, New York, NY, US, vol. 114, No. 2, Aug. 1, 2003, pp. 801-812.

Communication Pursuant to Article 94(3) EPC, mailed Mar. 30, 2010, in corresponding European Application No. 05766214.0 (8 pp.).

Japanese Office Action issued Feb. 1, 2011 in corresponding Japanese Patent Application 2007-526757.

English language version of International Search Report (PCT/ISA/210) mailed on Oct. 25, 2005 in connection with International Application No. PCT/JP2005/013602.

Chinese Office Action issued Sep. 29, 2012 in corresponding Chinese Patent Application No. 200580051179.2.

* cited by examiner

SOUND RECEIVER

CROSS REFERENCE TO RELATED APPLICATION

This application is a continuing application, filed under 35 U.S.C. §111(a), of International Application PCT/JP2005/013602, filed Jul. 25, 2005.

BACKGROUND OF THE INVENTION

1. Field of the Invention

The present invention relates to a sound receiver having a microphone array.

2. Description of the Related Art

Conventionally, a microphone device having directivity toward a specific speaker direction has been proposed as a sound input device. Such a microphone device is configured, for example, as follows. That is, the microphone device includes, for example, three non-directional microphone units A to C, where a combination of two of these forms a right channel (combination of microphone units A and C) or a left channel (combination of microphone units B and C). In the right channel, a low frequency component in the signal output from the microphone unit A is removed by a high pass filter, a phase of the signal output from the microphone unit C is delayed by a phase shifter, the signal output from the phase shifter is added in reverse phase to the signal output from the high pass filter, and a frequency characteristic is corrected by an equalizer to obtain an output signal. The same process is performed in the left channel so that a configuration enabling sound collection with a high S/N ratio is achieved (for example, refer to Japanese Patent No. 2770593).

Moreover, to achieve a configuration enabling sound collection with a high S/N ratio, a microphone device includes two non-directional microphone units A and B, in which a low frequency component of the signal output from the microphone unit A is removed by a high pass filter, a phase of the signal output from the non-directional microphone unit B is delayed by a phase shifter, the signal output from the phase shifter is added in reverse phase to the output signal of the high pass filter, and a frequency characteristic is corrected by an equalizer to output a signal, (for example, refer to Japanese Patent No. 2770594).

Furthermore, to achieve a configuration enabling miniaturization of the entire structure and to reduce deterioration of the directivity, a microphone device includes two unidirectional microphones, in which an air space of at least 1 cubic centimeter is provided between one of the microphones and an electrical circuit part arranged inside a casing in the maximum sensitivity direction of the one of the microphones, and an air space of at least 1 cubic centimeter is provided between the other one of the microphones and an electrical circuit part arranged inside a casing in a maximum sensitivity direction of the other one of the microphones, (for example, refer to Japanese Patent No. 2883082).

However, when the conventional microphone device described above is set in a place subject to relatively large vibrations, for example, in an interior of a traveling vehicle and the like, in these microphone devices, vibrations in a low frequency band of approximately 0 Hertz (Hz) to 200 Hz, caused by traveling, are received by the microphones. A noise in the signal occurs in the microphones since such vibrations of a low frequency band have a relatively large amplitude that exceeds an amplitude limit point of an amplifier for the microphones. It is known that accordingly, a sound signal corresponding to, for example, sound in a speech frequency band of a person becomes unclear, and there has been a problem in that particularly when such sound is recognized by a sound recognition system, the recognition rate is deteriorated.

In addition, since, for example, improvement of sound collection efficiency from a sound collection direction of the microphone device and phase dispersion are performed, there has been a problem in that such a problem is further aggravated when a microphone device in which a microphone is arranged inside an opening hole of a casing or the like is used because inner walls of the opening hole serve as diaphragms and vibrations generated therefrom reach the microphone as a sound wave.

SUMMARY OF THE INVENTION

It is an object of the present invention to at least solve the above problems in the conventional technologies.

A sound receiver according to one aspect of the present invention includes plural microphones that receive a sound wave; a casing that has plural cavities that respectively house the microphones and through which the sound wave enters, the cavities respectively having an inner wall; and plural supporting members, between the inner walls and the microphones, supporting and fixing the microphones in a position such that the microphones are not in contact with the inner walls, in which the position of the microphones is different from a volume center point of the cavities.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Referring to the accompanying drawings, exemplary embodiments according to the present invention are explained in detail below.

Figure 1:
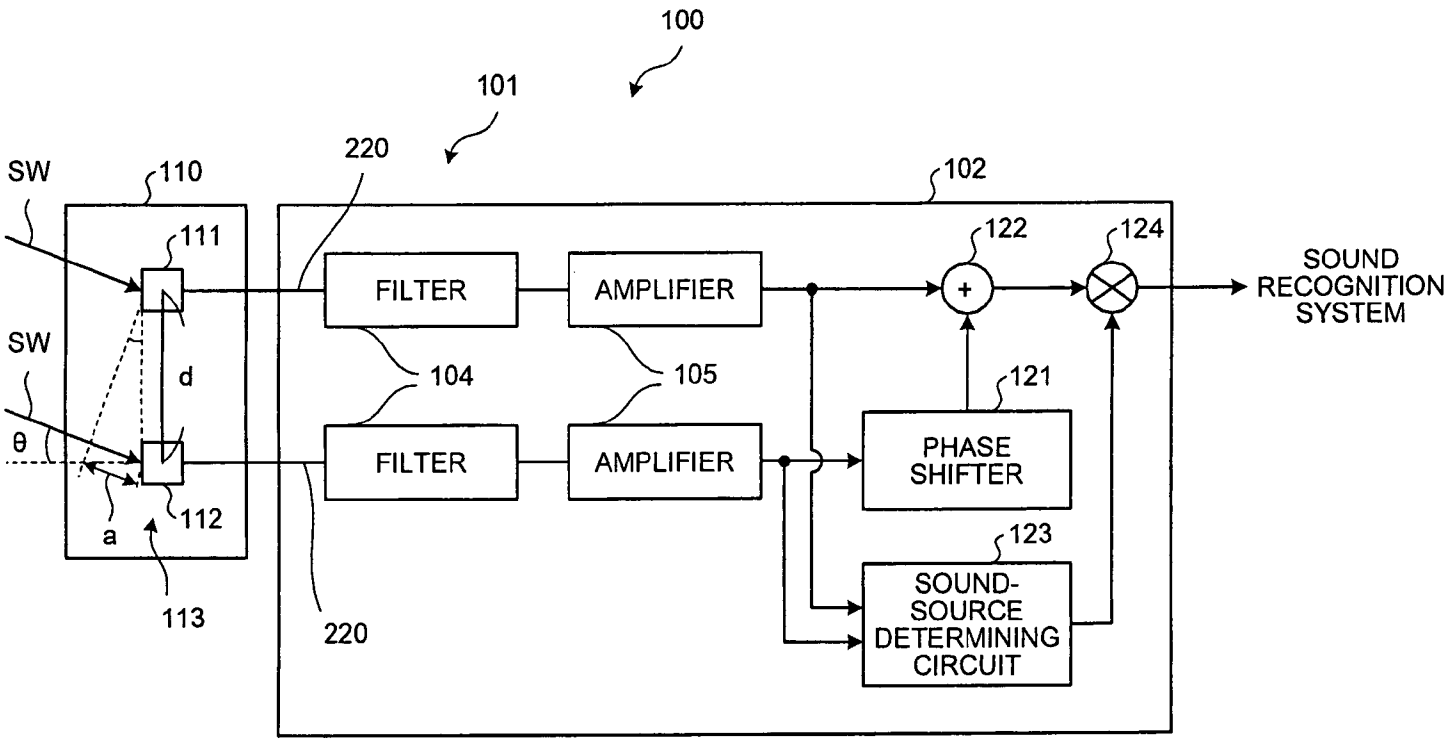
FIG. 1 is a block diagram of the sound processing device including the sound receiver according to an embodiment of the present invention.

FIG. 1 is a block diagram of the sound processing device including the sound receiver according to the embodiment of the present invention. As shown in FIG. 1, a sound processing device 100 includes a sound receiver 101 and a signal processing unit 102.

The sound receiver 101 is constituted of a casing 110 and a microphone array 113 that includes plural (two in the example shown in FIG. 1 for simplification) microphones 111 and 112. Each of the microphones 111 and 112 is constituted of a non-directional microphone, and the microphones 111 and 112 are arranged maintaining a predetermined distance d. The microphone array 113 receives a sound wave SW coming from an external source at a predetermined phase difference. Specifically, there is a time difference $\tau$ ($\tau=a/c$, where c is the speed of sound) that is shifted in time by an amount corresponding to a distance a ($a=d\cdot\sin\theta$).

The signal processing unit 102 estimates sound from a target sound source based on an output signal that is output from the microphone array 113 through an electrical wiring 220, and blocks an electrical signal that is generated due to mechanical vibrations. Specifically, for example, the signal processing unit 102 includes, as a basic configuration, plural filters 104 corresponding to the microphones 111 and 112, plural amplifiers 105 that are arranged subsequent to the filters 104, a phase shifter 121, an adder circuit 122, a sound-source determining circuit 123, and a multiplier circuit 124.

Figure 2:
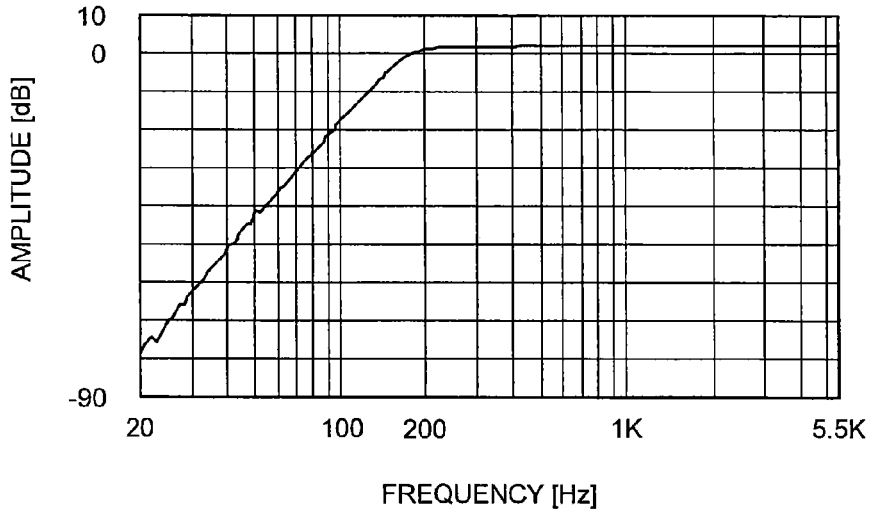
FIG. 2 is a frequency characteristic diagram for the filters of the sound receiver shown in FIG. 1.

FIG. 2 is a frequency characteristic diagram in the filters 104 of the sound receiver 101 shown in FIG. 1. The filters 104 are high pass filters (HPF) that are configured with a quadratic Butterworth circuit in which, for example, 200 Hz is a cut-off frequency. Since high pass filters are conventional technology, the explanation thereof is omitted herein.

The amplifiers 105 amplify, within a predetermined range, a signal output from the microphone array 113 and from which a low frequency component equal to or lower than 200 Hz has been removed by the filters 104. By thus removing a low frequency component by the filters 104 prior to amplification, by the amplifiers 105, of the signal output from the microphone array 113, it becomes possible to prevent a so-called scale-off phenomenon that is caused when a low-pitched signal generated by vibration is input to the amplifiers 105.

The phase shifter 121 makes an electrical signal, output from the microphone 112 and processed by the filter 104 and the amplifier 105, be in phase with an electrical signal output from the other microphone 111 and processed by the filter 104 and the amplifier 105. The adder circuit 122 adds the electrical signal output from the microphone 111 and processed by the filter 104 and the amplifier 105, and the signal output from the phase shifter 121. It is preferable if the phase shifter 121 is, for example, a digital phase shifter, and a phase calculation processing in the phase shifter 121 is achieved, for example, by performing Fourier transformation on the electrical signal and by performing a process using a frequency-phase spectrum in a Fourier space.

The sound-source determining unit 123 determines a sound source based on the electrical signal that is output from the microphone array 113 and is processed by the filters 104 and the amplifiers 105, and outputs a determination result of 1 bit ("1" for a target sound source; "0" for a non-target sound source). The multiplier circuit 124 multiplies an output signal from the adder circuit 122 and a determination result from the sound-source determining unit 123.

An output signal that is from the signal processing unit 102 and multiplied by the multiplier circuit 124 is output to, for example, a sound recognition system not shown. When a speaker (not shown) is arranged subsequent to the signal processing unit 102, configuration can be such that the sound signal estimated by the signal processing unit 102, in other words, the sound corresponding to the output signal from the multiplier circuit 124, is output. Although in this example, the sound receiver 101 and the signal processing unit 102 are separately structured, for example, the signal processing unit 102 can be provided in the sound receiver 101.

Figure 3:
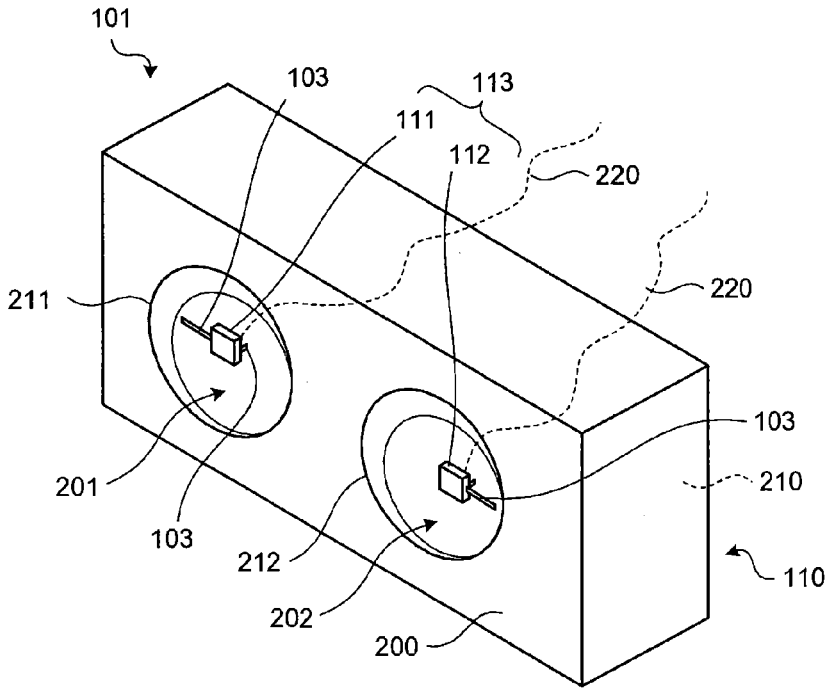
FIG. 3 is a perspective view illustrating an external appearance of the sound receiver shown in FIG. 1.

FIG. 3 is a perspective view illustrating an external appearance of the sound receiver 101 shown in FIG. 1. As shown in FIG. 3, the casing 110 of the sound receiver 101 is, for example, in a rectangular parallelepiped. Furthermore, the casing 110 is formed with a sound absorbing material selected from among, for example, acrylic resin, silicon rubber, urethane, aluminum, and the like. On a front surface 200 of the casing 110, plural (two in the example shown in FIG. 3) opening cavities 201 and 202 are formed in the number corresponding to the number (two in the example shown in FIG. 3) of the microphones 111 and 112 that constitute the microphone array 113. The opening cavities 201 and 202 are formed, for example, along a longitudinal direction of a front surface 200 of the casing 101 in a line in a state in which opening ends 211 and 212 thereof are positioned on a side of the front surface 200.

Figure 4:
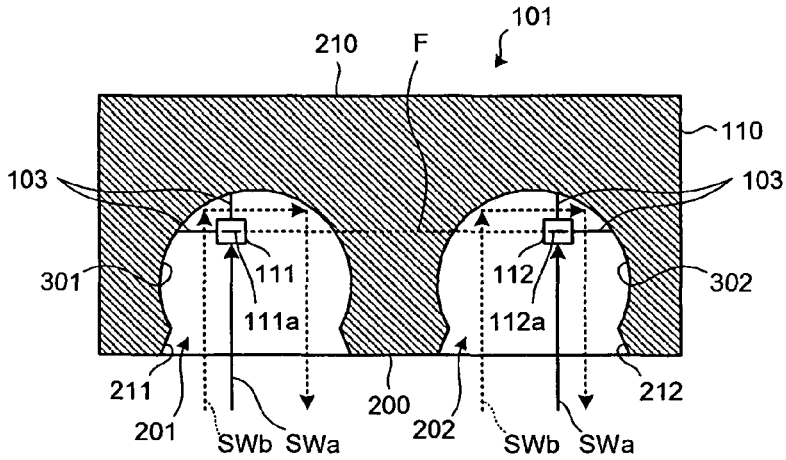
FIG. 4 is a cross-section of the sound receiver according to a first example.

Furthermore, as shown in FIG. 4, the opening cavities 201 and 202 are formed so as to have, for example, inner peripheral walls 301 and 302 in a substantially parabolic shape that does not open through a rear surface 210 of the casing 110, respectively, and the microphones 111 and 112 are positioned at positions different from focus points (three-dimensional center points), in other words, positions different from the volume center points, of the opening cavities 201 and 202, respectively, and are supported by supporting springs 103 (in this example, plural pieces for one microphone) serving as supporting members in a fixed manner. This enables to prevent a concentration effect of unnecessary sound waves that are generated by vibrations occurring when the microphones 111 and 112 are arranged at the volume center points. The supporting springs 103 are illustrated simply in a rod shape herein. The supporting member (supporting springs 103) is not necessarily required to be provided in plural for each of the microphones 111 and 112.

As a material of the supporting member including the supporting spring 103, a metallic material such as aluminum, a sponge material of acryl or silicon, a plastic material such as polyethylene terephthalate (PET) and polyethylene naphthalate (PEN), an elastomer, or the like can be used, and when the supporting spring 103 is employed as the supporting member, it is preferable to be formed with a metallic material. The material of such a supporting member is selected so that a resonance of the microphones 111 and 112 caused by vibrations of the casing 110 from movement of a vehicle and the like can be prevented.

Moreover, the arrangement of the microphones 111 and 112 in the opening cavities 201 and 202 can be any arrangement provided that the microphones 111 and 112 can be viewed through opening ends 211 and 212 and do not closely contact the inner peripheral walls 301 and 302, respectively. As described, by arranging the microphones 111 and 112 at positions different from the volume center points of the respective opening cavities 201 and 202 through the supporting springs 103, both prevention of the concentration of sound waves due to vibrations and prevention of an occurrence of a low frequency band signal caused by resonance can be achieved mechanically.

Furthermore, in the signal processing unit 102, by removing a low frequency component from the output signal from the microphone array 113 by the filters 104 before amplifying to perform a phase processing by the amplifiers 105, a flexible phase processing can be performed while blocking an electrical signal that is generated due to mechanical vibrations. Therefore, in the sound processing device 100, a recognition rate of a sound signal and an S/N ratio can be improved with a simple configuration.

Figure 5:
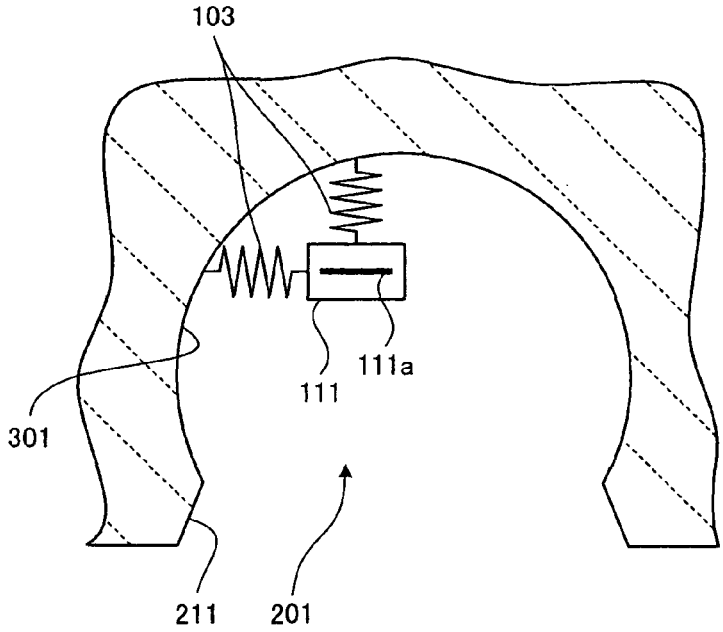
FIG. 5 is an enlarged partial view of the sound receiver shown in FIG. 4.

FIG. 4 is a cross-section of the sound receiver according to a first example. FIG. 5 is an enlarged partial view of the sound receiver shown in FIG. 4. The cross-sections shown in FIGS. 4 and 5 are an example of a cross-section of the sound receiver shown in FIG. 3. Like reference characters are used to identify like components with the components shown in FIG. 3 and the explanation thereof is omitted.

As shown in FIG. 4, the opening cavities 201 and 202 are formed in a substantially spherical shape that does not open through the rear surface 210, and sound waves are input through the opening ends 211 and 212 that are formed on the front surface 200 of the casing 110. The shape of the opening cavities 201 and 202 is not limited to a spherical shape, and can be a solid shape or a polyhedron that have random curved surfaces. A sound wave from an external source is input to the opening cavities 201 and 202 only through the opening ends 211 and 212, and a sound wave from directions other than this direction is blocked by the casing 110 that is formed with the sound absorbing material, and therefore, not input to the opening cavities 201 and 202. Such a configuration enables to improve the directivity of the microphone array 113 (see FIG. 1).

Moreover, the microphones 111 and 112 arranged inside the opening cavities 201 and 202 are supported by the supporting springs 103 that extend in a direction perpendicular to the microphones 111 and 112 from the inner peripheral walls 301 and 302 at positions different from the volume center points of the respective opening cavities 201 and 202 in a fixed manner to the casing 110. Furthermore, the microphones 111 and 112 are arranged in the opening cavities 201 and 202, respectively, in a state in which main surfaces of diaphragms 111*a* and 112*a* provided therein are positioned on the same plane (indicated by a dotted line F in FIG. 4).

As described, by arranging the microphones 111 and 112 in the opening cavities 201 and 202 such that the main surfaces of the diaphragms 111*a* and 112*a* are positioned on the same plane, a phase adjustment processing by the phase shifter 121 in a stage subsequent to the signal processing unit 102 is equalized between the microphones 111 and 112. Moreover, when the microphones 111 and 112 are arranged such that the main surfaces of the diaphragms 111*a* and 112*a* are positioned on the same plane, it becomes unnecessary to perform precise adjustment of arranging positions in the opening cavities 201 and 202. Therefore, assembling work for the sound receiver 101 can be simplified.

As shown in FIG. 5, the microphone 111 is supported by the supporting springs 103 at a position different from the volume center point of the opening cavity 201 in a state of not closely contacting the inner peripheral wall 301 of the opening cavity 201 in a fixed manner. The microphone 111 is arranged such that the main surface of the diaphragm 111*a* therein receives a sound wave (not shown). In such a state, for example, when the relation of "mass of the casing 110>>mass of the microphone 111" is true, the material of the supporting springs 103 is determined such that the resonance frequency of the mass of the supporting springs 103 and the microphone 111 is outside a low frequency band, such as, for example, 50 Hz to 100 Hz. In this example, plural pieces of the supporting springs 103 support to fix one piece of the microphone 111 or 112. However, as described above, configuration can be such that the support is by a single piece of the supporting spring 103.

With such a configuration, as shown in FIG. 4, a sound wave SWa that directly reaches the microphones 111 and 112 is directly received by the microphones 111 and 112 at the predetermined phase difference. On the other hand, a sound wave SWb that reaches the inner peripheral walls 301 and 302 of the opening cavities 201 and 202 passes through the inner peripheral walls 301 and 302 to be absorbed by the inner peripheral walls 301 and 302, or is reflected by the inner peripheral walls 301 and 302 to be output from the opening cavities 201 and 202. Thus, reception of the sound wave SWb can be suppressed.

Moreover, with such a configuration, the positions at which the microphones 111 and 112 are arranged inside the opening cavities 201 and 202 differ from the positions at which sound waves caused by vibrations of the casing 110 are concentrated in the opening cavities 201 and 202, and the microphones 111 and 112 are supported by the supporting springs 103 formed with a material that is selected so that a resonance frequency is not in a low frequency band in a state of not closely contacting the inner peripheral walls 301 and 302 in a fixed manner. Therefore, both mechanical vibrations to the microphones 111 and 112 caused by vibrations of the casing 110 and an electrical signal that is generated due to the vibrations are shielded, thereby enabling highly accurate reception of sound waves.

As described, with the sound receiver 101 according to the first example, only a sound wave coming from a predetermined direction is received and reception of a sound wave coming from directions other than the predetermined direction and a sound wave generated by mechanical vibrations can be effectively prevented, thereby achieving an effect that a target sound wave can be accurately and efficiently detected for recognition, and a sound receiver that has high directivity and in which an S/N ratio can be improved is implemented.

Figure 6:
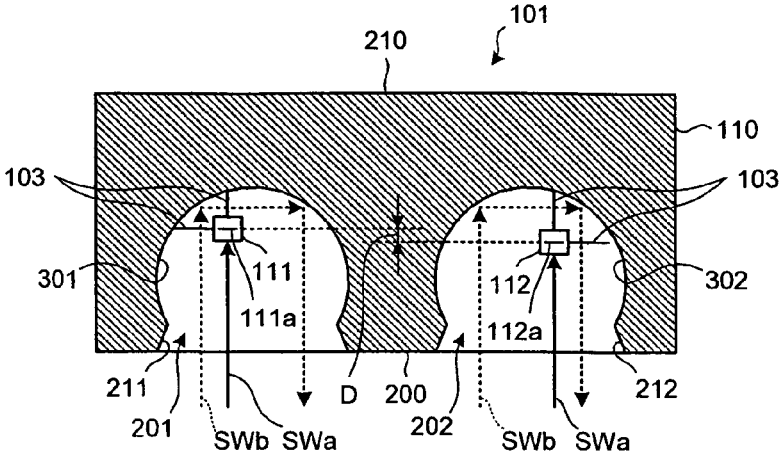
FIG. 6 is a cross-section of the other example of the sound receiver according to the first example.

FIG. 6 is a cross-section of the other example of the sound receiver 101 according to the first example. As shown in FIG. 6, in the microphones 111 and 112 arranged inside the opening cavities 201 and 202 having a substantially spherical shape that does not open through the rear surface 210, main surfaces of the diaphragms 111*a* and 112 thereof are not positioned on the same plane, and the diaphragms 111*a* and 112*a* are arranged in a state in which the main surfaces are parallel to each other maintaining a predetermined distance D.

In such a configuration also, the sound wave SWa that directly reaches the microphones 111 and 112 is directly received by the microphones 111 and 112 at the predetermined phase difference. Although since the positions at which the microphones 111 and 112 are arranged in the opening cavities 201 and 202 are not the same but different subtly, processes in the phase shifter 121 in the signal processing unit 102 (see FIG. 1) are different for each of the output signals from the microphones 111 and 112, it is possible to detect to recognize a target sound wave accurately and efficiently, and to improve the directivity and the S/N ratio, similarly to the sound receiver 101 shown in FIG. 4.

Figure 7:
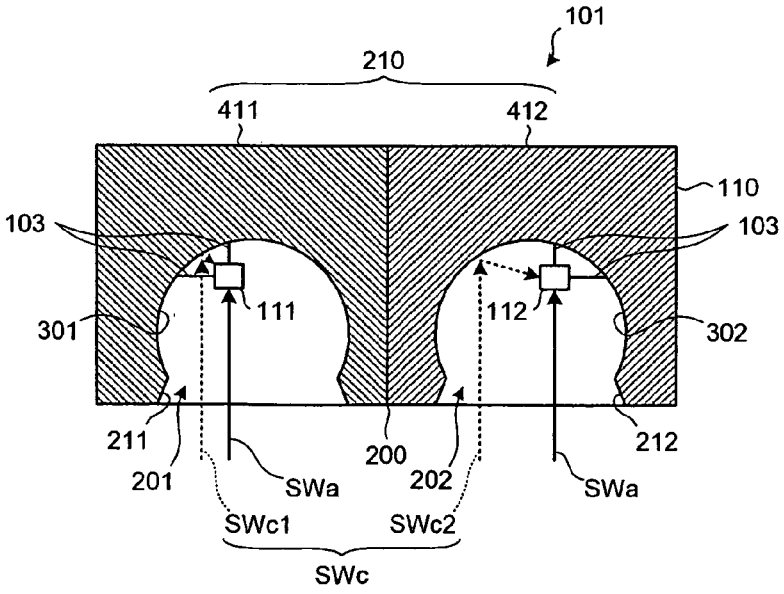
FIG. 7 is a cross-section of the sound receiver according to a second example.

The sound receiver according to the second example is an example in which an inner peripheral wall of each opening cavity is formed with a different material. FIG. 7 is a cross-section of the sound receiver according to the second example. The cross-section shown in FIG. 7 is an example of the cross-section of the sound receiver 101 shown in FIG. 3. Like reference characters are used to identify like components with the components shown in FIGS. 3 to 6, and the explanation thereof is omitted.

As shown in FIG. 7, the casing 110 is constituted of plural (two in the example shown in FIG. 7) cells 411 and 412 that are formed with sound absorbing materials having different hardness for each of the microphones 111 and 112. The opening cavities 201 and 202 in a substantially spherical shape that does not open through the rear surface 210 are formed for the cells 411 and 412, respectively, and the microphones 111 and 112 are housed in the opening cavities 201 and 202, respectively. The material of the cells 411 and 412 is selected from among acrylic resin, silicon rubber, urethane, aluminum, and the like described above. Specifically, for example, the cell 411 can be formed with acrylic resin, and the other cell 412 can be formed with silicon rubber.

In such a configuration, the sound wave SWa that directly reaches the microphones 111 and 112 is directly received by the microphones 111 and 112 at the predetermined phase difference as shown in FIG. 1. On the other hand, a sound wave SWc (SWc1, SWc2) that reaches the inner peripheral walls 301 and 302 of the opening cavities 201 and 202 of the cells 411 and 412 is reflected by the inner peripheral walls 301 and 302 of the opening cavities 201 and 202. At this time, the sound wave SWc1 that is reflected by the inner peripheral wall 301 of the opening cavity 201 in the cell 411 changes in phase corresponding to the material of the cell 411.

Moreover, the sound wave SWc2 that is reflected by the inner peripheral wall 302 of the opening cavity 202 in the other cell 412 changes in phase corresponding to the material of the other cell 412. Since the hardness of the materials of the cell 411 and the other cell 412 is different, the phase change of the sound waves SWc1 and SWc2 is also different from each other. Therefore, the sound wave SWc is received by the microphones 111 and 112 at a phase difference that is different from the phase difference of the sound wave SWa, and is determined as noise by the sound-source determining circuit 123 shown in FIG. 1.

Moreover, similarly to the sound receiver 101 according to the first example, the positions at which the microphones 111 and 112 are arranged differ from the positions at which sound waves caused by vibrations of the casing 110 are concentrated, and the microphones 111 and 112 are supported by the supporting springs 103 such that a resonance frequency is not in a low frequency band, in a state of not closely contacting the inner peripheral walls 301 and 302 in a fixed manner. Therefore, both mechanical vibrations and an electrical signal that is generated due to the vibrations are shielded, thereby enabling highly accurate reception of sound waves.

As described, according to the sound receiver 101 of the second example, an effect similar to that of the first example can be achieved. Moreover, there are effects that a target sound, that is, sound of the sound wave SWa, can be accurately detected by disarranging the phase difference of the sound wave SWc from an undesirable direction with a simple configuration, that an unnecessary sound wave in a low frequency band that is generated due to mechanical vibrations can be shielded, and that a sound receiver that has high directivity and high sensitivity, and in which the S/N ratio is improved can be implemented.

Figure 8:
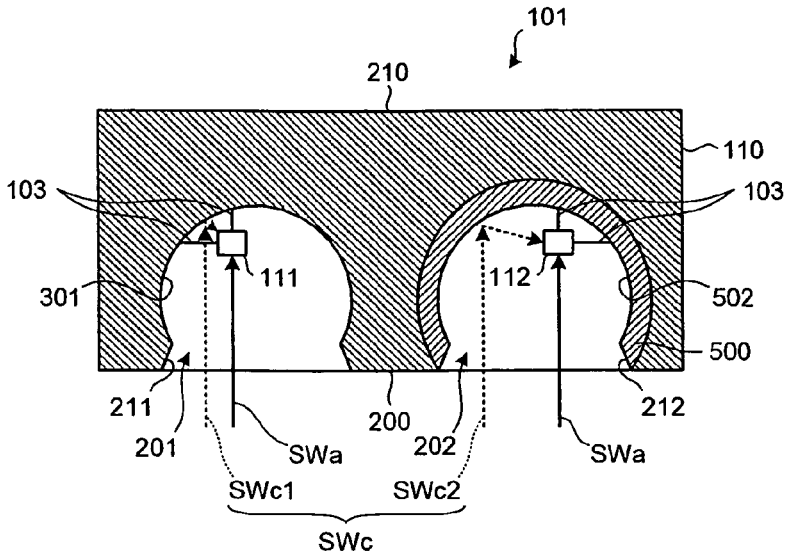
FIG. 8 is a cross-section of the sound receiver according to a third example.

Next, the sound receiver 101 according to the third example is explained. The sound receiver according to the third example is an example in which the materials of a casing and a sound absorbing member that form the inner peripheral walls of respective opening cavities are different. FIG. 8 is a cross-section of the sound receiver according to the third example. The cross-section shown in FIG. 8 is an example of the cross-section of the sound receiver 101 shown in FIG. 3. Like reference characters are used to identify like components with the components shown in FIGS. 3 to 7, and the explanation thereof is omitted.

In the example shown in FIG. 8, an inner peripheral wall 502 of the opening cavity 202 having a substantially spherical shape that does not open through the rear surface 210 is formed with a porous sound absorbing member 500 that is different in hardness from the casing 110. Materials of the casing 110 and the sound absorbing member 500 that forms the inner peripheral wall 502 are selected from among, for example, acrylic resin, silicon rubber, urethane, aluminum, and the like described above. Specifically, for example, when the casing 110 is formed with acrylic resin, the sound absorbing member 500 that forms the inner peripheral wall 502 is formed with a material other than acrylic resin, for example, with silicon rubber.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 301 of the opening cavity 201 is reflected by the inner peripheral wall 301 of the opening cavity 201. At this time, the sound wave SWc1 that is reflected by the inner peripheral wall 301 of the opening cavity 201 changes in phase according to the material of the casing 110.

On the other hand, the sound wave SWc2 that is reflected by the inner peripheral wall 502 of the other opening cavity 202 changes in phase according to the material of the sound absorbing member 500 that forms the other inner peripheral wall 502. Since the hardness of the material of the casing 110 that forms the inner peripheral wall 301 of the opening cavity 201 and the material of the sound absorbing member 500 that forms the inner peripheral wall 502 of the other opening cavity 202 differ, the phase change of the sound waves SWc1 and SWc2 also differ from each other. Therefore, the sound wave SWc is received by the microphones 111 and 112 at a phase difference that is different from the phase difference of the sound wave SWa, and is determined as noise by the sound-source determining circuit 123 shown in FIG. 1.

Moreover, similarly to the sound receiver 101 according to the first example and the second example, the positions at which the microphones 111 and 112 are arranged differ from the positions at which sound waves caused by vibrations of the casing 110 are concentrated, and the microphones 111 and 112 are supported by the supporting springs 103 such that a resonance frequency is not in a low frequency band, in a state of not closely contacting the inner peripheral walls 301 and 502 in a fixed manner. Therefore, both mechanical vibrations and an electrical signal that is generated due to the vibrations are shielded, thereby enabling highly accurate reception of sound waves.

Figure 9:
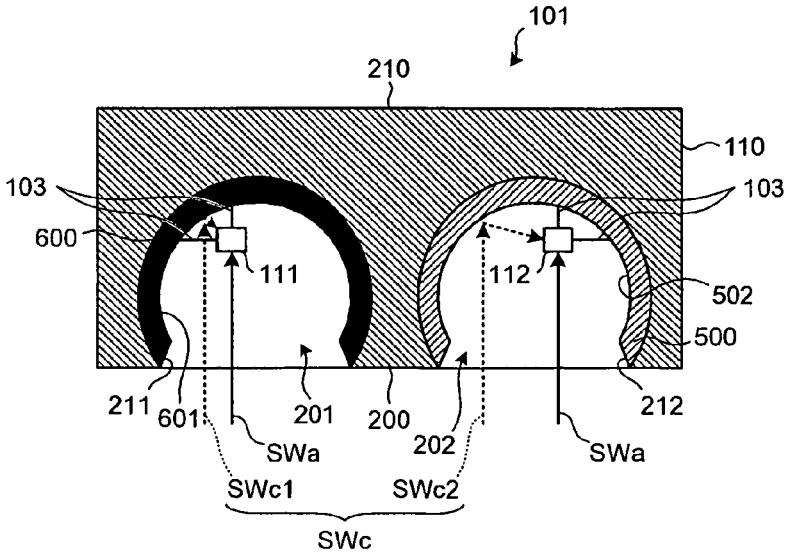
FIG. 9 is a cross-section of another example of the sound receiver according to the third example.

Next, another example of the sound receiver 101 shown in FIG. 8 is explained. FIG. 9 is a cross-section of another example of the sound receiver 101 according to the third example. In the example shown in FIG. 9, inner peripheral walls 601 and 502 of the opening cavities 201 and 202 having a substantially spherical shape that does not open through the rear surface 210 are formed with sound absorbing members 600 and 500 that are different from each other. A material of the sound absorbing member 600 is also selected from among, for example, acrylic resin, silicon rubber, urethane, aluminum, and the like described above, similarly to the sound absorbing member 500. Specifically, for example, when the sound absorbing member 600 that forms the inner peripheral wall 601 is formed with acrylic resin, the sound absorbing member 500 that forms the inner peripheral wall 502 is formed with a material other than acrylic resin, for example, with silicon rubber.

In this configuration as well, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 601 of the opening cavity 201 is reflected by the inner peripheral wall 601 of the opening cavity 201. At this time, the sound wave SWc1 that is reflected by the inner peripheral wall 601 of the opening cavity 201 changes in phase according to the material of the casing 110.

On the other hand, the sound wave SWc2 that is reflected by the inner peripheral wall 502 of the other opening cavity 202 changes in phase according to the material of the sound absorbing member 500 that forms the other inner peripheral wall 502. Since the hardness of the material of the sound absorbing member 600 that forms the inner peripheral wall 601 of the opening cavity 201 and the material of the sound absorbing member 500 that forms the inner peripheral wall 502 of the other opening cavity 202 differ, the phase change of the sound waves SWc1 and SWc2 also differ from each other. Therefore, the sound wave SWc is received by the microphones 111 and 112 at a phase difference that is different from the phase difference of the sound wave SWa, and is determined as noise by the sound-source determining circuit 123 shown in FIG. 1.

Moreover, similarly to the sound receiver 101 according to the first example and the second example, the positions at which the microphones 111 and 112 are arranged differ from the positions at which sound waves caused by vibrations of the casing 110 are concentrated, and the microphones 111 and 112 are supported by the supporting springs 103 such that a resonance frequency is not in a low frequency band, in a state of not closely contacting the inner peripheral walls 601 and 502 in a fixed manner. Therefore, both mechanical vibrations and an electrical signal that is generated due to the vibrations are shielded, thereby enabling highly accurate reception of sound waves.

Figure 10:
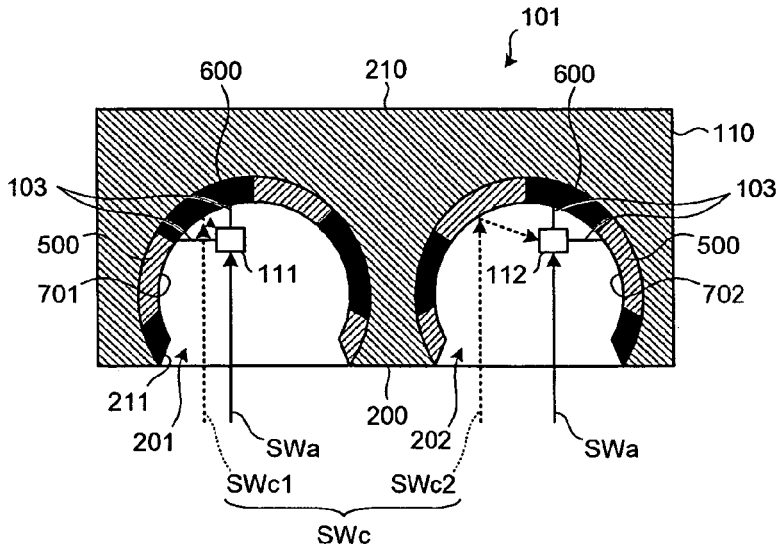
FIG. 10 is a cross-section of another example of the sound receiver according to the third example.

Next, another example of the sound receiver 101 shown in FIG. 8 is explained. FIG. 10 is a cross-section of another example of the sound receiver 101 according to the third example. In the example shown in FIG. 10, an inner peripheral wall 701 of one of the opening cavity 201 having a substantially spherical shape that does not open through the rear surface 210 is formed with the sound absorbing members 500 and 600 in plural (in FIG. 10, two types are shown). Moreover, an inner peripheral wall 702 of the other opening cavity 202 having a substantially spherical shape that does not open through the rear surface 210 is also formed with the sound absorbing members 500 and 600 in plural (two in the example shown in FIG. 10).

Arrangement of the sound absorbing members 500 and 600 are different in the opening cavities 201 and 202, and if the same sound wave reaches each of the opening cavities 201 and 202, the sound wave is reflected on a surface of the sound absorbing members 500 (600) different from each other. This enables to change the phase of the sound waves SWc1 and SWc2 that are reflected by the inner peripheral walls 701 and 702 randomly. Therefore, the sound wave SWc is received by the microphones 111 and 112 at a phase difference that is different from the phase difference of the sound wave SWa, and is determined as noise by the sound-source determining circuit 123 shown in FIG. 1.

As described, according to the sound receiver 101 of the third example, an effect similar to that of the first example and the second example can be achieved. Moreover, there are effects that a target sound, that is, sound of the sound wave SWa, can be accurately detected by altering the phase difference of the sound wave SWc from an undesirable direction with a simple configuration, that an unnecessary sound wave in a low frequency band that is generated due to mechanical vibrations can be blocked, and that a sound receiver that has high directivity and high sensitivity, and in which the S/N ratio is improved can be implemented.

Figure 11:
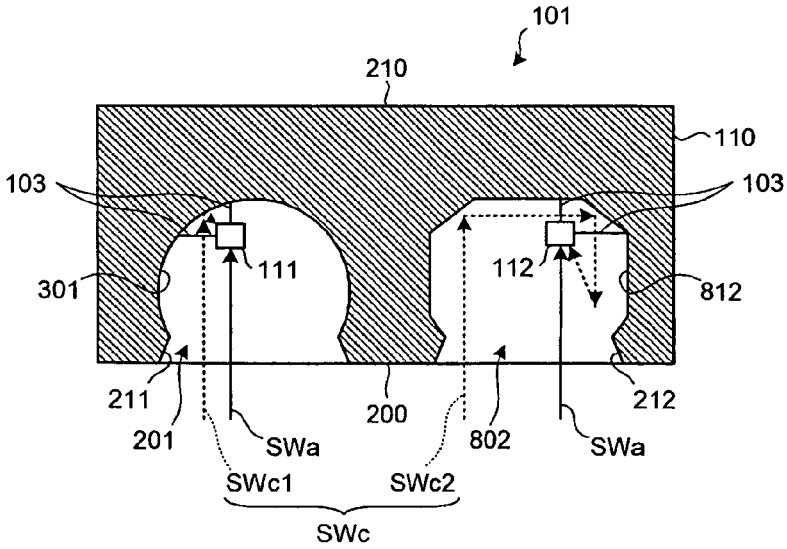
FIG. 11 is a cross-section of the sound receiver according to a fourth example.

The sound receiver according to the fourth example is an example in which the shape of opening cavities is different from each other. FIG. 11 is a cross-section of the sound receiver according to the fourth example. The cross-section shown in FIG. 11 is an example of a cross-section of the sound receiver 101 shown in FIG. 3. Like reference characters are used to identify like components with the components shown in FIG. 3, and the explanation thereof is omitted.

In the example shown in FIG. 11, opening cavities 201 and 802 are formed in different shapes from each other. In the example shown in FIG. 11, the opening cavity 201 that does not open through the rear surface 210 is formed to have a substantially circular cross-section, in other words, in a substantially spherical shape, and the other opening cavity 802 is formed to have a substantially polygonal cross-section, in other words, in a substantially polyhedron.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 301 of the opening cavity 201 is reflected by the inner peripheral wall 301 of the other opening cavity 201 and is received by the microphone 111.

On the other hand, the sound wave SWc2 that reaches the inner peripheral wall 812 of the other opening cavity 802 is reflected by the inner peripheral wall 812 of the other opening cavity 802 to be received by the microphone 112. Since the opening cavities 201 and 802 in the casing 110 are formed in different shapes from each other, the reflection path length of the sound wave SWc1 and the reflection path length of the sound wave SWc2 are different. Therefore, the sound wave SWc is received by the microphones 111 and 112 at a phase difference that is different from the phase difference of the sound wave SWa, and is determined as noise by the sound-source determining circuit 123 shown in FIG. 1.

Moreover, similarly to the sound receiver 101 according to the first example and the second example, the positions at which the microphones 111 and 112 are arranged differ from the positions at which sound waves caused by vibrations of the casing 110 are concentrated, and the microphones 111 and 112 are supported by the supporting springs 103 such that resonance frequency is not in a low frequency band, in a state of not closely contacting the inner peripheral walls 301 and 812 in a fixed manner. Therefore, both mechanical vibrations and an electrical signal that is generated due to the vibrations are blocked, thereby enabling highly accurate reception of sound waves.

As described, according to the sound receiver 101 of the fourth example, an effect similar to that of the first example can be achieved. Moreover, only by forming the opening cavities in different shapes, the phase difference of the sound wave SWc from an undesirable direction is disarranged with a simple configuration, and there are effects that a target sound, that is, sound of the sound wave SWa, can be accurately detected, that an unnecessary sound wave in a low frequency band that is generated due to mechanical vibrations can be shielded, and that a sound receiver that has high directivity and high sensitivity, and in which the S/N ratio is improved can be implemented.

Figure 12:
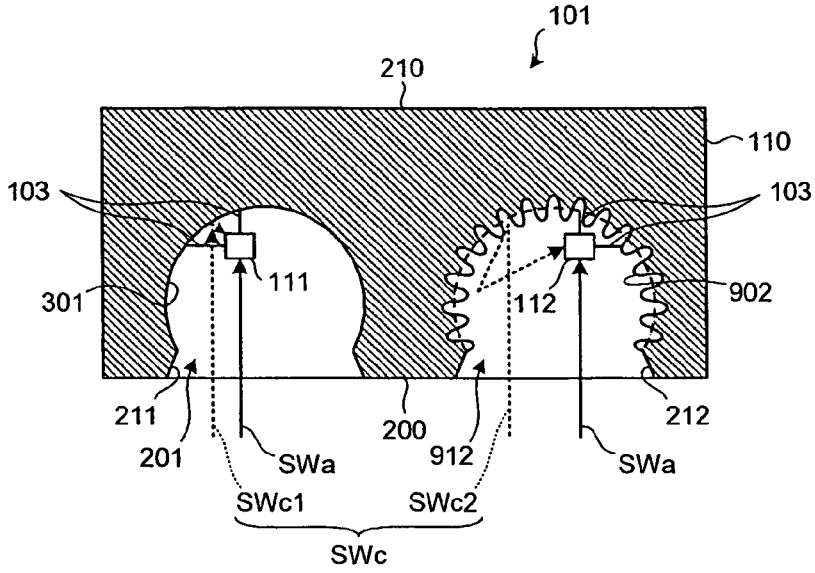
FIG. 12 is a cross-section of the sound receiver according to a fifth example.

The sound receiver according to the fifth example is an example in which the shape of opening cavities is different from each other. FIG. 12 is a cross-section of the sound receiver according to the fifth example. The cross-section shown in FIG. 11 is an example of a cross-section of the sound receiver 101 shown in FIG. 3. Like reference characters are used to identify like components with the components shown in FIG. 3, and the explanation thereof is omitted.

As shown in FIG. 12, opening cavities 201 and 912 that do not open through the rear surface 210 are formed in the same shape. In the example shown in FIG. 12, the opening cavities 201 and 912 are formed to have the same substantially circular cross-sections, in other words, in a substantially spherical shape, as an example. While the inner peripheral wall 301 to be the surface of the opening cavity 201 is smoothed, an inner peripheral wall 902 to be the surface of the opening cavity 912 has a random rough surface (protrusions). The vertical intervals of the rough surface can be arbitrarily set, and can be set to protrusions that are not broken by vibration caused by a sound wave. In an actual situation, the vertical interval is desirable to be, for example, 2 mm to 4 mm, and more specifically, to 3 mm.

In such a configuration, the sound wave SWa that directly reaches the microphones 111 and 112 is directly received by the microphones 111 and 112 at the predetermined phase difference as shown in FIG. 1. On the other hand, the sound wave SWc1 that reaches the inner peripheral wall 301 of the opening cavity 201 is reflected by the inner peripheral wall 301 of the opening cavity 201 and is received by the microphone 111.

On the other hand, the sound wave SWc2 that reaches the inner peripheral wall 902 of the other opening cavity 912 is reflected by the inner peripheral wall 902 of the other opening cavity 912 to be received by the microphone 112. Since the opening cavities 201 and 912 in the casing 110 are formed in different shapes from each other, the reflection path length of the sound wave SWc1 and the reflection path length of the sound wave SWc2 are different.

Therefore, a phase difference corresponding to a path length difference between the reflection path length of the sound wave SWc1 and the reflection path length or the sound wave SWc2 is generated in the sound wave SWc. Accordingly, the sound wave SWc is received by the microphones 111 and 112 at a phase difference that is different from the phase difference of the sound wave SWa, and is determined as noise by the sound-source determining circuit 123 shown in FIG. 1.

Moreover, similarly to the sound receiver 101 according to the first example, the positions at which the microphones 111 and 112 are arranged differ from the positions at which sound waves caused by vibrations of the casing 110 are concentrated, and the microphones 111 and 112 are supported by the supporting springs 103 such that resonance frequency is not in a low frequency band, in a state of not closely contacting the inner peripheral walls 301 and 902 in a fixed manner. Therefore, both mechanical vibrations and an electrical signal that is generated due to the vibrations are blocked, thereby enabling highly accurate reception of sound waves.

As described, according to the sound receiver 101 of the fifth example, an effect similar to that of the first example can be achieved. Moreover, since the inner peripheral wall 902 that is different from the inner peripheral wall 301 can be formed by making a rough surface only on the surface of the opening cavity 912 while both of the opening cavities 201 and 912 are formed in the same shape using the same mold or the like, there is an effect that a sound receiver can be easily manufactured. If a random rough surface (protrusions) that is different from that of the inner peripheral wall 902 is formed also on the inner peripheral wall 301 similarly to the inner peripheral wall 902, a similar effect can be achieved.

Furthermore, with such a simple configuration, particularly by varying the surface figure of the opening cavities, the phase difference of the sound wave SWc from an undesirable direction is disarranged, thereby achieving effects that a target sound, that is, sound of the sound wave SWa, can be accurately detected, that an unnecessary sound wave in a low frequency band that is generated due to mechanical vibrations can be shielded, and that a sound receiver that has high directivity and high sensitivity, and in which the S/N ratio is improved can be implemented.

Figure 13:
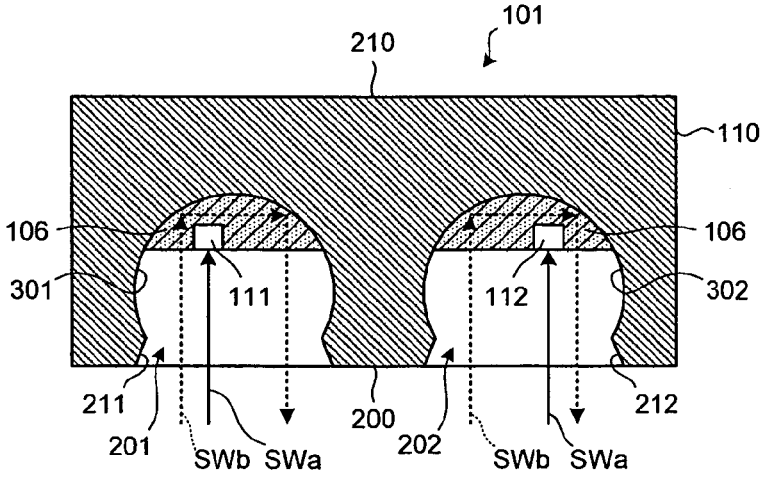
FIG. 13 is a cross-section of the sound receiver according to a sixth example.

The sound receiver according to the sixth example is an example in which a structure of a supporting member that supports the microphones 111 and 112 is different. FIG. 13 is a cross-section of the sound receiver according to the sixth example. The cross-section shown in FIG. 13 is an example of the cross-section of the sound receiver 101 shown in FIG. 3 in which the structure inside the opening cavities 201 and 202 is changed. Like reference characters are used to identify like components with the components shown in FIG. 3, and the explanation thereof is omitted.

As shown in FIG. 13, the opening cavities 201 and 202 that do not open through the rear surface 210 are formed in a substantially spherical shape, and sound waves are input through the opening ends 211 and 212 that are formed on the front surface 200 of the casing 110. The microphones 111 and 112 arranged inside the opening cavities 201 and 202 are supported in a fixed manner by, for example, supporting sponges 106 that closely contact the inner peripheral walls 301 and 302 and that cover surfaces of the microphones 111 and 112 other than surfaces to which a sound wave reaches, at such positions that are different from the volume center points of the opening cavities 201 and 202 and that main surfaces of diaphragms not shown are positioned on the same plane.

The supporting sponges 106 are formed with a sponge material of acrylic or silicon rubber as described above, and support the microphones 111 and 112, respectively, such that the microphones 111 and 112 do not closely contact the inner peripheral walls 301 and 302 of the opening cavities 201 and 202 in a fixed manner. For example, when relation of "mass of the casing 110>>mass of the microphone 111 (112)" is true, a material of the supporting sponges 106 is determined so that a resonance frequency of the mass of the supporting sponges 106 and the microphone 111 is not in a low frequency band including the frequency band of, for example, 50 Hz to 100 Hz.

Although not illustrated, the supporting sponges 106 can be arranged so as to close an internal space of the opening cavities 201 and 202 in a state of internally containing the microphones 111 and 112, respectively. Moreover, the supporting sponges 106 and the inner peripheral walls 310 and 302 can be glued to each other with, for example, a resin adhesive or the like.

Furthermore, as the supporting member of the microphones 111 and 112, a combination of the supporting spring 103 and the supporting sponge 106, or a supporting member (not shown) in a form of elastic rod can be used. When the supporting spring 103 and the supporting sponge 106 are used in combination, for example, the supporting sponge 106 can be arranged to support and fix a surface of the microphones 111 and 112 opposite to the surface to which a sound wave reaches, and the supporting spring 103 can be arranged on a surface of the microphones 111 and 112 perpendicular to the surface to which a sound wave reaches to support and fix the microphones 111 and 112.

With such a configuration, as shown in FIG. 13, the sound wave SWa that directly reaches the microphones 111 and 112 is directly received by the microphones 111 and 112 at the predetermined phase difference. On the other hand, the sound wave SWb that reaches the inner peripheral walls 301 and 302 of the opening cavities 201 and 202 passes through the inner peripheral walls 301 and 302 to be absorbed by the inner peripheral walls 301 and 302, or is reflected by the inner peripheral walls 301 and 302 to be output from the opening cavities 201 and 202.

Moreover, with such a configuration, similarly to the case of the first example, the positions at which the microphones 111 and 112 are arranged inside the opening cavities 201 and 202 differ from the positions at which sound waves caused by vibrations of the casing 110 are concentrated in the opening cavities 201 and 202, and the microphones 111 and 112 are supported by the supporting sponges 106 formed with a material that is selected so that a resonance frequency is not in a low frequency band, in a state of not closely contacting the inner peripheral walls 301 and 302 in a fixed manner. Therefore, both mechanical vibrations to the microphones 111 and 112 caused by vibrations of the casing 110 and an electrical signal that is generated due to the vibrations are shielded, thereby enabling highly accurate reception of sound waves.

Furthermore, with this configuration, the microphones 111 and 112 can be installed in the casing 110 with such a simple operation that after the microphones 111 and 112 are arranged in the supporting sponges 106, the supporting sponges 106 are set in the opening cavities 201 and 202. Therefore, an assembly work thereof can be simplified.

As described, with the sound receiver 101 according to the sixth example, a sound wave coming from only a predetermined direction is received and reception of a sound wave coming from directions other than the predetermined direction and a sound wave generated by mechanical vibrations can be effectively prevented, thereby achieving an effect that a target sound wave can be accurately and efficiently detected, and that a sound receiver that has high directivity and in which an S/N ratio can be improved is implemented.

Figure 14:
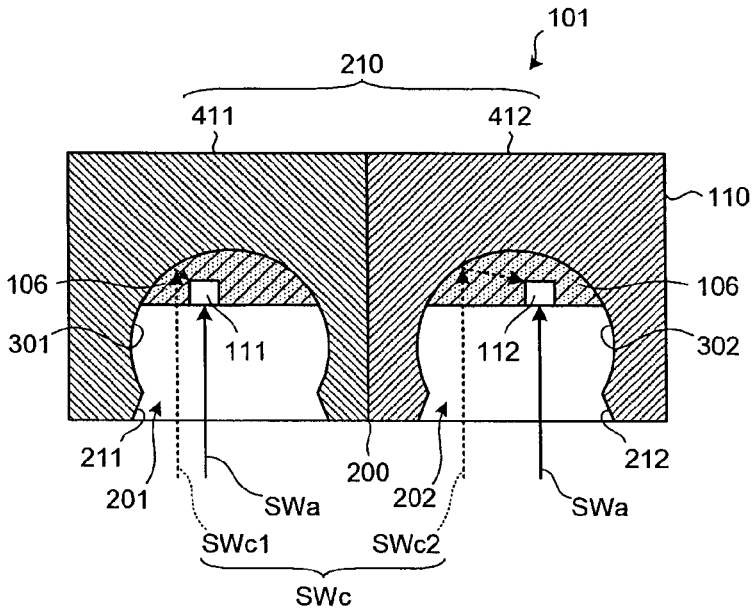
FIG. 14 is a cross-section of the sound receiver according to a seventh example.

The sound receiver according to the seventh example is an example in which material of the inner peripheral walls of respective opening cavities are different. FIG. 14 is a cross-section of the sound receiver according to the seventh example. The cross-section shown in FIG. 14 is an example of the cross-section of the sound receiver 101 shown in FIG. 3 in which the structure inside the opening cavities 201 and 202 is changed. Like reference characters are used to identify like components with the components shown in FIGS. 3 and 13, and the explanation thereof is omitted.

In the example shown in FIG. 14, the casing 110 is constituted of the cells 411 and 412 in plural (two in the example shown in FIG. 14) that are formed with sound absorbing materials having different hardness for each of the microphones 111 and 112. The opening cavities 201 and 202 in a substantially spherical shape that does not open through the rear surface 210 are formed for the cells 411 and 412, respectively, and the microphones 111 and 112 are housed in the opening cavities 201 and 202 through the supporting sponges 106, respectively. The material of the cells 411 and 412 is selected from among, for example, acrylic resin, silicon rubber, urethane, aluminum, and the like described above. Specifically, for example, the cell 411 can be formed with acrylic resin, and the other cell 412 can be formed with silicon rubber.

In such a configuration, the sound wave SWa that directly reaches the microphones 111 and 112 is directly received by the microphones 111 and 112 at the predetermined phase difference as shown in FIG. 1. On the other hand, the sound wave SWc (SWc1, SWc2) that reaches the inner peripheral walls 301 and 302 of the opening cavities 201 and 202 of the cells 411 and 412 are reflected by the inner peripheral walls 301 and 302 of the opening cavities 201 and 202. At this time, the sound wave SWc1 that is reflected by the inner peripheral wall 301 of the opening cavity 201 in the cell 411 changes in phase corresponding to the material of the cell 411.

Moreover, the sound wave SWc2 that is reflected by the inner peripheral wall 302 of the opening cavity 202 in the other cell 412 changes in phase corresponding to the material of the other cell 412. Since the hardness of the materials of the cell 411 and the other cell 412 is different, the phase change of the sound waves SWc1 and SWc2 is also different from each other. Therefore, the sound wave SWc is received by the microphones 111 and 112 at a phase difference that is different from the phase difference of the sound wave SWa, and is determined as noise by the sound-source determining circuit 123 shown in FIG. 1.

With such a configuration, similarly to the case of the sixth example, the positions at which the microphones 111 and 112 are arranged inside the opening cavities 201 and 202 differ from the positions at which sound waves caused by vibrations of the casing 110 are concentrated in the opening cavities 201 and 202, and the microphones 111 and 112 are supported by the supporting sponges 106 formed with a material that is selected so that a resonance frequency is not in a low frequency band in a state of not closely contacting the inner peripheral walls 301 and 302 in a fixed manner. Therefore, both mechanical vibrations to the microphones 111 and 112 caused by vibrations of the casing 110 and an electrical signal that is generated due to the vibrations are shielded, thereby enabling highly accurate reception of sound waves.

Furthermore, with this configuration, the microphones 111 and 112 can be installed in the casing 110 with such a simple operation that after the microphones 111 and 112 are arranged in the supporting sponges 106, the supporting sponges 106 are set in the opening cavities 201 and 202. Therefore, an assembly work thereof can be simplified.

As described, with the sound receiver 101 according to the seventh example, an effect similar to that of the sixth example can be achieved. Moreover, there are effects that a target sound, that is, sound of the sound wave SWa, can be accurately detected by disarranging the phase difference of the sound wave SWc from an undesirable direction with a simple configuration, that an unnecessary sound wave in a low frequency band that is generated due to mechanical vibrations can be shielded, and that a sound receiver that has high directivity and high sensitivity, and in which the S/N ratio is improved can be implemented.

Figure 15:
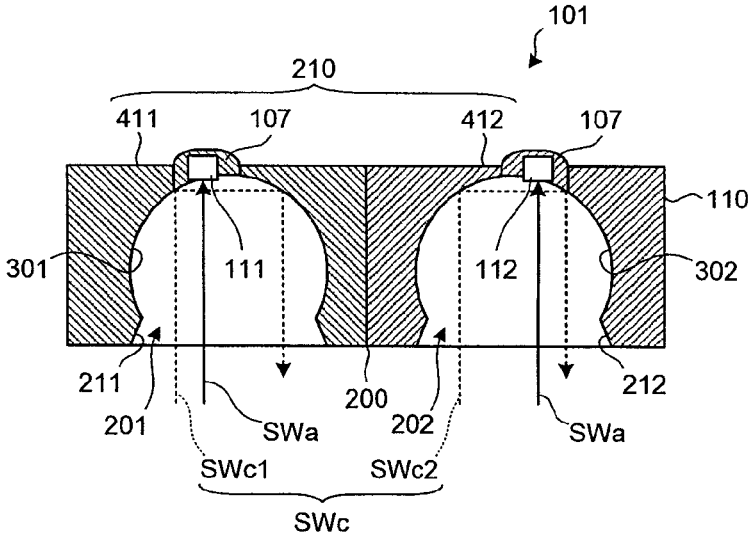
FIG. 15 is a cross-section of the sound receiver according to an eighth example.

The sound receiver according to the eighth example is an example in which supporting members that support the microphones 111 and 112 penetrate through the rear surface 210 in the opening cavities having a substantially parabolic shape that does not open through the rear surface 210 of the casing 110. FIG. 15 is a cross-section of the sound receiver according to the eighth example. The cross-section shown in FIG. 15 is an example of the cross-section of the sound receiver 101 shown in FIG. 3 in which the structure inside the opening cavities 201 and 202 is changed. Like reference characters are used to identify like components with the components shown in FIG. 3, and the explanation thereof is omitted.

As shown in FIG. 15, the opening cavities 201 and 202 are formed in a substantially spherical shape that does not open through the rear surface 210, and sound waves are input through the opening ends 211 and 212 that are formed on the front surface 200 of the casing 110 that is constituted of the cells 411 and 412. The microphones 111 and 112 that are arranged inside the opening cavities 201 and 202 are supported in a fixed manner by, for example, supporting silicon rubbers 107 that closely contact the inner peripheral walls 301 and 302, that cover surfaces of the microphones 111 and 112 other than the surface to which a sound wave reaches, and that penetrate through the rear surface 210, instead of the supporting springs 103 described above, at such positions that are different from the volume center points of the opening cavities 201 and 202 and that main surfaces of diaphragms not shown are positioned on the same plane.

The supporting silicon rubbers 107 support the microphones 111 and 112, respectively, such that the microphones 111 and 112 do not closely contact the inner peripheral walls 301 and 302 of the opening cavities 201 and 202 in a fixed manner. For example, when relation of "mass of the casing 110>>mass of the microphone 111 (112)" is true, a material of the supporting silicon rubber 107 is determined so that a resonance frequency of the mass of the supporting silicon rubber 107 and the microphone 111 is not in a low frequency band including the frequency band of, for example, 50 Hz to 100 Hz.

With such a configuration, as shown in FIG. 15, the sound wave SWa that directly reaches the microphones 111 and 112 is directly received by the microphones 111 and 112 at the predetermined phase difference. On the other hand, the sound wave SWb that reaches the inner peripheral walls 301 and 302 of the opening cavities 201 and 202 passes through the inner peripheral walls 301 and 302 to be absorbed by the inner peripheral walls 301 and 302, or is reflected by the inner peripheral walls 301 and 302 to be output from the opening cavities 201 and 202.

Moreover, with such a configuration, similarly to the case of the first example, the positions at which the microphones 111 and 112 are arranged inside the opening cavities 201 and 202 differ from the positions at which sound waves caused by vibrations of the casing 110 are concentrated in the opening cavities 201 and 202, and the microphones 111 and 112 are supported in a fixed manner by the supporting silicon rubber 107 formed with a material that is selected so that a resonance frequency is not in a low frequency band in a state of not closely contacting the inner peripheral walls 301 and 302. Therefore, both mechanical vibrations to the microphones 111 and 112 caused by vibrations of the casing 110 and an electrical signal that is generated due to the vibrations are shielded, thereby enabling highly accurate reception of sound waves.

Furthermore, with this configuration, the microphones 111 and 112 can be installed in the casing 110 with such a simple operation that after the microphones 111 and 112 are arranged in the supporting silicon rubber 107, the supporting silicon rubber 107 are set in the opening cavities 201 and 202. Therefore, an assembly work thereof can be simplified.

As described, with the sound receiver 101 according to the eighth example, a sound wave coming from only a predetermined direction is received and reception of a sound wave coming from directions other than the predetermined direction and a sound wave generated by mechanical vibrations can be effectively prevented, thereby achieving an effect that a target sound wave can be accurately and efficiently detected, and that a sound receiver that has high directivity and in which an S/N ratio can be improved is implemented.

Figure 16:
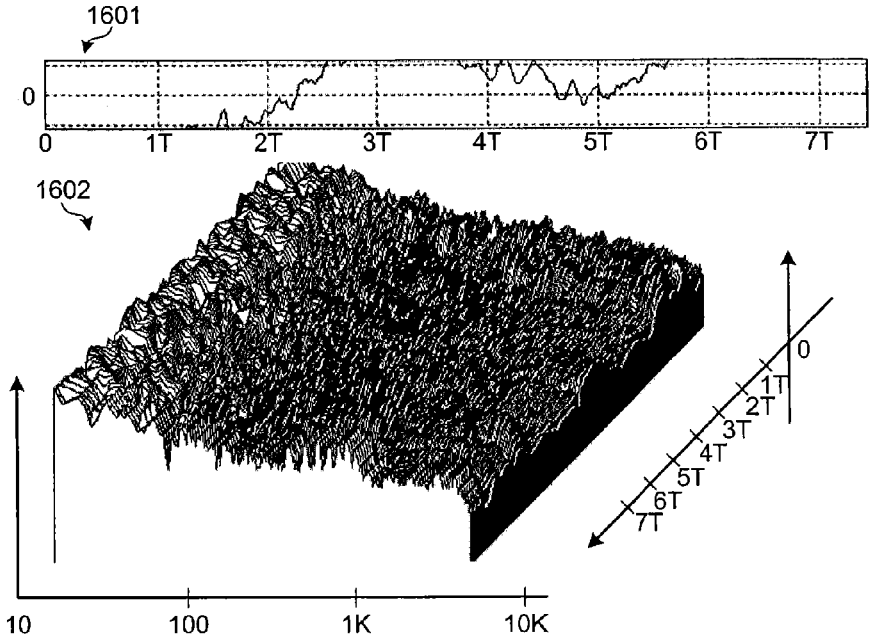
FIG. 16 is an explanatory diagram showing a change of frequency amplitude and frequency characteristic of the sound processing device including a conventional sound receiver over time.
Figure 17:
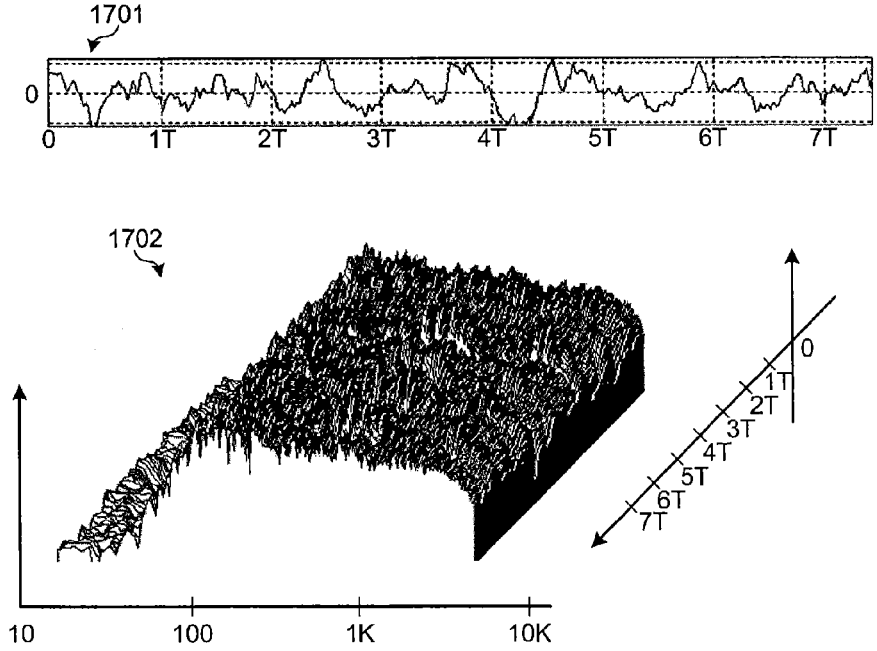
FIG. 17 is an explanatory diagram showing a change of the frequency amplitude and the frequency characteristic of the sound processing device including the sound receiver according to the embodiment of the present invention over time.

FIG. 16 is an explanatory diagram showing a change of the frequency amplitude and the frequency characteristic of the sound processing device including a conventional sound receiver over time, and FIG. 17 is an explanatory diagram showing a change of the frequency amplitude and the frequency characteristic of the sound processing device including the sound receiver according to the embodiments of the present invention over time.

In graphs 1601 and 1701 shown in FIGS. 16 and 17, a vertical axis represents an amplitude of an electrical signal having large amplitude in a low frequency band of, for example, 20 Hz to 200 Hz that is originated in movement of a vehicle and the like that is output from the sound processing device 100 (see FIG. 1), and a horizontal axis represents an elapsed time (T). The amplitude and the elapsed time of the electrical signal are three-dimensionally expressed in three-dimensional graphs 1602 and 1702.

When the graphs 1601 and 1701 and the three-dimensional graphs 1602 and 1702 are compared, the waveform of the electrical signal shown in the graph 1601 and the three-dimensional graph 1602 has become off-scale (out of range) between a point passed an elapsed time 2T and a point before an elapsed time 4T, and at around a point passing an elapsed time 5T. Therefore, a part of an electrical signal of a frequency band including, for example, voice of human is also lost. On the other hand, the waveform of the electrical signal shown in the graph 1701 and the three-dimensional graph 1702 shows a stable state obtained by the configuration described in the first to the eighth examples described above and the configuration in which an output signal from the microphone array 113 is processed in the order of the filters 104, the amplifiers 105, and the phase shifter 121. Accordingly, the sound processing device 100 including the sound receiver 101 according to the embodiments of the present invention can accurately receive a sound wave from a target sound source and efficiently remove a sound wave from a non-target sound source, thereby improving the sound recognition rate and the S/N ratio.

Figure 18:
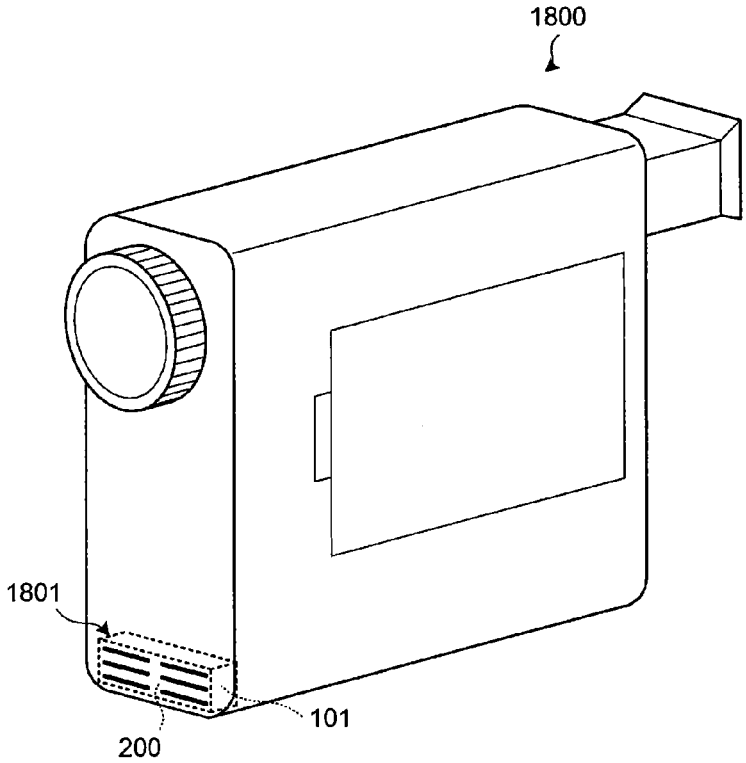
FIG. 18 illustrates an example of application to a video camera.
Figure 19:
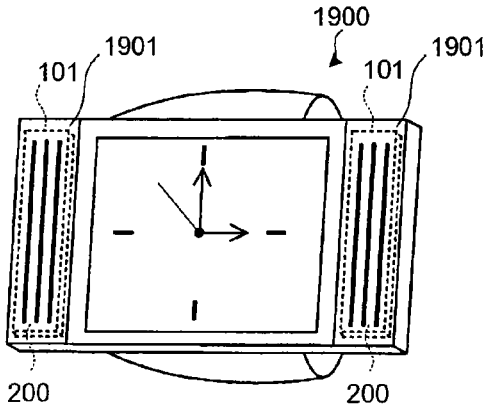
FIG. 19 illustrates an example of application to a watch.
Figure 20:
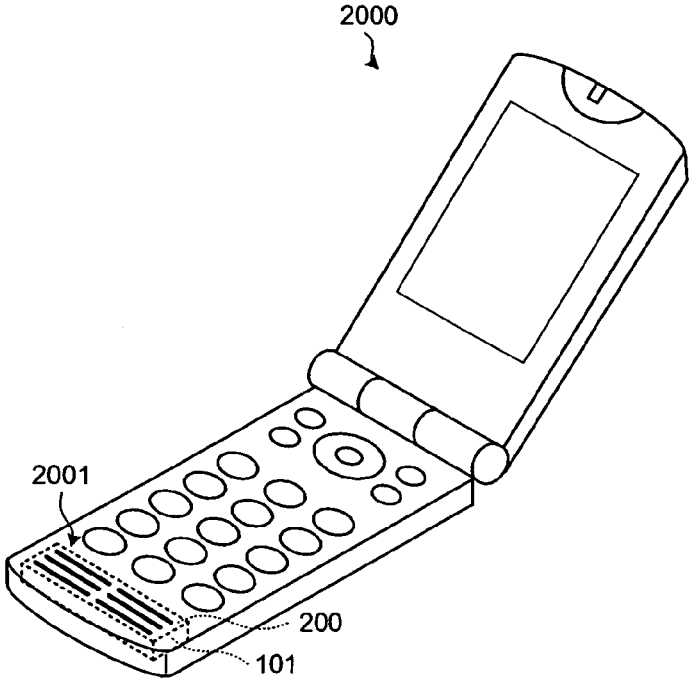
FIG. 20 illustrates an example of application to a mobile telephone.

FIG. 18 to FIG. 20 are explanatory diagrams showing application examples of the sound receiver according to the embodiments of the present invention. FIG. 18 illustrates an example of application to a video camera. The sound receiver 101 is built in a video camera 1800, and the front surface 200 and a slit plate 1801 abut on each other. Moreover, FIG. 19 illustrates an example of application to a watch.

The sound receivers 101 are built in a watch 1900 at right and left sides of a dial thereof, and the front surfaces 200 and the slit plates 1901 abut on each other. Furthermore, FIG. 20 illustrates an example of application to a mobile telephone.

The sound receiver 101 is built in a mobile telephone 2000 at a mouthpiece, and the front surface 200 and a slip plat 2001 abut on each other. Thus, it is possible to accurately receive a sound wave from a target sound source.

As described above, according to the embodiments of the present invention, an effect that a sound wave from a target sound source can be accurately detected to be recognized by such an arrangement that a sound wave coming from only a predetermined direction is received and reception of a sound wave coming from a direction other than the predetermined direction and a sound wave generated by mechanical vibrations is effectively suppressed, and an effect that a sound receiver in which a microphone array has high directivity, and in which a sound recognition rate is improved can be implemented are achieved. Moreover, by disarranging a phase difference of a sound wave from an undesirable direction with a simple configuration, effects that a sound wave from a target sound source can be accurately detected, that an unnecessary sound wave in a low frequency band that is generated due to mechanical vibrations can be shielded, and that a sound receiver that has high directivity and high sensitivity, and in which the S/N ratio is improved can be implemented are achieved.

While in the embodiments described above, the microphones 111 and 112 are arranged in a line, the microphones 111 and 112 can be two-dimensionally arranged depending on an environment or a device to which the sound receiver 101 is applied. Furthermore, the microphones 111 and 112 used in the embodiments described above are desirable to be non-directional microphones. This enables to provide a low-cost sound receiver. Furthermore, in the embodiments described above, explanation is given applying both the configuration in which the microphones 111 and 112 are arranged at such positions that are different from the volume center points of the opening cavities and that the microphones 111 and 112 do not closely contact the inner peripheral walls through the supporting members, and the configuration in which phase control is performed by removing a signal component in a predetermined low frequency band in the order of the filters 104, the amplifiers 105, and the phase shifter 121. However, even if only either one is applied, a sound receiver that has high directivity and high sensitivity, and in which the S/N ratio is improved can be implemented.

The sound receiver according to the embodiments explained above, effects improvement of the S/N ratio of a sound signal by a simple configuration.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sound receiver comprising:

a plurality of microphones that receive a sound wave;

a casing that has a plurality of cavities that respectively house the microphones and through which the sound wave enters, the cavities respectively having an inner wall and having a substantially parabolic shape; and a plurality of supporting members, between the inner walls and the microphones, supporting and fixing the microphones in a position such that the microphones are not in contact with the inner walls, wherein the position of the microphones is different from a focus point of the substantially parabolic shape, and the sound receiver is a non-contact sound receiver.

2. The sound receiver according to claim 1, wherein the microphones are non-directional microphones.

3. The sound receiver according to claim 1, wherein the microphones are arranged such that main surfaces of a plurality of diaphragms provided therein are arranged on an identical plane.

4. The sound receiver according to claim 1, wherein the supporting members are formed with an elastic body of a material such that a resonance frequency of a mass of supporting members and of the microphones is outside a predetermined low frequency band.

5. The sound receiver according to claim 4, wherein the predetermined low frequency band includes a frequency band of 50 Hertz to 100 Hertz.

6. The sound receiver according to claim 4, wherein the elastic body is formed with at least one of a sponge material, a spring material, a plastic material, and an elastomer.

7. The sound receiver according to claim 1 further comprising:

a high pass filter that removes a frequency component in a predetermined low frequency band from an electrical signal output from the microphones, and outputs an electrical signal composed of frequency components that remain;

an amplifier that amplifies the electrical signal output from the high pass filter; and a phase shifter that, based on the electrical signal amplified by the amplifier, phase-shifts the sound wave received by each of the microphones to be in phase.

8. The sound receiver according to claim 7, wherein the predetermined low frequency band includes a frequency band of 50 Hertz to 100 Hertz.

9. The sound receiver according to claim 7, wherein the phase shifter performs phase calculation processing using a frequency-phase spectrum by Fourier transformation.

10. A sound receiver comprising:

a plurality of microphones that receive a sound wave;

a casing that has a plurality of cavities that respectively house the microphones and through which the sound wave enters, the cavities respectively having an inner wall and having a substantially parabolic shape;

a plurality of supporting members, between the inner walls and the microphones, supporting and fixing the microphones in a position such that the microphones are not in contact with the inner walls;

a high pass filter that removes a frequency component in a predetermined low frequency band from an electrical signal output from the microphones, and outputs an electrical signal composed of frequency components that remain;

an amplifier that amplifies the electrical signal output from the high pass filter; and a phase shifter that, based on the electrical signal amplified by the amplifier, phase-shifts the sound wave received by each of the microphones to be in phase, wherein the position of the microphones is different from a volume center point of the cavities and is different from a focus point of the substantially parabolic shape.

11. The sound receiver according to claim 10, wherein the predetermined low frequency band includes a frequency band of 50 Hertz to 100 Hertz.

12. The sound receiver according to claim 10, wherein the phase shifter performs phase calculation processing using a frequency-phase spectrum by Fourier transformation.

13. A sound receiver comprising:

a plurality of microphones that receive a sound wave;

a casing that has a plurality of cavities that respectively house the microphones and through which the sound wave enters, the cavities having a substantially parabolic shape;

a supporting member that contacts an inner peripheral wall of the cavities, covers surfaces of the microphones other than a surface to which the sound wave reaches, and penetrates through the casing on an opposite side of an opening of a cavity, wherein the microphones are supported by the supporting member such that a position of the microphones is different from a focus point of the substantially parabolic shape, and the sound receiver is a non-contact sound receiver.

14. The sound receiver according to claim 13, wherein the microphones are non-directional microphones.

15. The sound receiver according to claim 13, wherein the microphones are arranged such that main surfaces of a plurality of diaphragms provided therein are arranged on an identical plane.

16. The sound receiver according to claim 13, wherein the supporting member is formed with an elastic body of a material such that a resonance frequency of a mass of the supporting member and of the microphones is outside a predetermined low frequency band.

17. The sound receiver according to claim 16, wherein the predetermined low frequency band includes a frequency band of 50 Hertz to 100 Hertz.

18. The sound receiver according to claim 16, wherein the elastic body is formed with at least one of a sponge material, a spring material, a plastic material, and an elastomer.

19. The sound receiver according to claim 13 further comprising:

a high pass filter that removes a frequency component in a predetermined low frequency band from an electrical signal output from the microphones, and outputs an electrical signal composed of frequency components that remain;

an amplifier that amplifies the electrical signal output from the high pass filter; and a phase shifter that, based on the electrical signal amplified by the amplifier, phase-shifts the sound wave received by each of the microphones to be in phase.

20. The sound receiver according to claim 19, wherein the predetermined low frequency band includes a frequency band of 50 Hertz to 100 Hertz.

21. The sound receiver according to claim 19, wherein the phase shifter performs phase calculation processing using a frequency-phase spectrum by Fourier transformation.

22. A sound receiver comprising:

a plurality of microphones that receive a sound wave;

a casing that has a plurality of cavities that respectively house the microphones and through which the sound wave enters, the cavities respectively having an inner wall and having a substantially parabolic shape;

a plurality of supporting members, between the inner walls and the microphones, supporting and fixing the microphones in a position such that the microphones are not in contact with the inner walls;

a high pass filter that removes a frequency component in a predetermined low frequency band from an electrical signal output from the microphones, and outputs an electrical signal composed of frequency components that remain;

an amplifier that amplifies the electrical signal output from the high pass filter; and a phase shifter that, based on the electrical signal amplified by the amplifier, phase-shifts the sound wave received by each of the microphones to be in phase, wherein the position of the microphones is different from a focus point of the substantially parabolic shape.

23. The sound receiver according to claim 22, wherein the predetermined low frequency band includes a frequency band of 50 Hertz to 100 Hertz.

24. The sound receiver according to claim 22, wherein the phase shifter performs phase calculation processing using a frequency-phase spectrum by Fourier transformation.

* * * * *